US005277513A

United States Patent [19]

Flanagan et al.

[11] Patent Number: 5,277,513

[45] Date of Patent: Jan. 11, 1994

[54] SNOWPLOWABLE PAVEMENT MARKER USING DIFFERENT MATERIALS

[75] Inventors: Robert M. Flanagan, Lincolnshire; Sidney A. Heenan, Park Ridge; Henry R. Krepel, Crystal Lake; Richard M. Steere, Itasca, all of Ill.

[73] Assignee: Stimsonite Corporation, Niles, Ill.

[21] Appl. No.: 805,571

[22] Filed: Dec. 10, 1991

[51] Int. Cl.[5] ..... E01F 9/04

[52] U.S. Cl. ..... 404/16

[58] Field of Search ..... 404/9-12, 14, 15-16

[56] References Cited

U.S. PATENT DOCUMENTS

| | | | |
|---|---|---|---|
| 3,409,344 | 11/1968 | Balint et al. | 404/9 |
| 3,516,337 | 6/1970 | Gubela | 404/9 |
| 3,975,108 | 8/1976 | Suhr et al. | 404/16 |
| 3,980,410 | 9/1976 | Suhr et al. | 404/16 |
| 4,155,666 | 5/1979 | Flanagan | 404/16 |
| 4,195,945 | 4/1980 | Heenan | 404/16 |
| 4,634,310 | 1/1987 | Clarke | 404/15 |

*Primary Examiner*—Kenneth J. Dorner
*Assistant Examiner*—Nancy P. Connolly
*Attorney, Agent, or Firm*—Jones, Day, Reavis & Pogue

[57] ABSTRACT

A low-profile snowplowable pavement marker is disclosed including a base member and a retroreflector. The base member has two arcuate-bottom keel members interconnected by a support member. The upper surfaces of the keel members define inclined ramps. The spacing of inner surfaces of the ramps allows retroreflectance of oncoming light while accommodating larger plow blade angles encountered in higher speed plowing. The support member has a central planar support surface for carrying the retroreflector and upwardly facing curved top surfaces providing relief in the base member between the ramps and in front of the retroreflector to allow tires of approaching vehicles to wipe the lens assembly. The housing of the retroreflector is molded from long-glass-fiber-reinforced composite thermoplastic material with a recess for accommodating a retroreflective lens element of a different thermoplastic material.

44 Claims, 3 Drawing Sheets

SNOWPLOWABLE PAVEMENT MARKER USING DIFFERENT MATERIALS

BACKGROUND OF THE INVENTION

The present invention relates to pavement markers of the retroreflector type which are cleaned by the action of vehicle tires contacting the marker, and in particular to such pavement markers which are suitable for use in snow areas and are, therefore, constructed so as to protect the retroreflector from contact with snowplow blades.

BACKGROUND OF THE INVENTION

Pavement markers have become widely accepted as permanent installations for providing visible signals which mark traffic lanes and control the flow of traffic on roadways in connection with, or in place of, conventional painted traffic lines. A large number of such markers employ reflectors which retroreflect light emanating from oncoming vehicles to provide a visible signal to the operators of such oncoming vehicles.

A pavement marker of the type depicted in U.S. Pat. No. 4,195,945 and assigned to applicants' assignee, has generally been manufactured in two different versions. The first has a pavement to top of marker height of 0.41 inch high, and is known as a Stimsonite® Model 96. The second has a pavement to top of marker height of 0.25 inch, and is known as a Stimsonite Model 96 LP. The model 96 has an outside ramp angle of 6°, while the model 96LP has an outside ramp angle of 4°. The reduced height of the model 96LP, even though using the same Stimsonite "Model 944" retroreflector, results in approximately 40% of the reflector element being shielded by the road, and thus the retroreflected signal from the 96LP is not as great as the signal from the model 96.

While both models have operated satisfactorily and have been commercially successful, the 96 LP has been utilized in those states where there tends to be either higher speed plowing or much higher traffic volume and its lower height than the model 96 permits less jolting of the operator, particularly during such high speed plow operations as found in expressways in certain parts of the country where there is extremely heavy snowfall conditions.

In certain states, stripping or scarffing of old levels of asphalt for repaving is done from time to time. The snowplowable markers as depicted in the '945 patent are removed with the old asphalt and those removing them occasionally have sought to recycle the casting by submitting the casting to various tumbling and cleaning techniques.

Because the prior art castings were not originally structured for such purpose, casting recycling may leave certain sections of the ramps more susceptible to fracture over extended re-use than the ramps of the original casting. Also, the positioning tabs may be broken off during removal and tumbling, thus rendering subsequent reinstallation of the recycled casting less accurate.

In some areas in which heavier snows occur the plow operators also may tend to adjust the plow blade relative to the longitudinal axis of the roadway, to an angle which may allow the tip of the plow blade to cut away or damage the reflector, or may increase the plow angle such that the plow blade, even though straddling both casting rails or ramps, can drop below the ramps sufficiently to contact the retroreflector and thus damage it.

The present invention provides both an improved retroreflector and casting member; each provides a longer life member, and the configuration and combination of the casting and retroreflector are such that the impact or jolt at high speed plowing is still kept to a relative minimum; the initial retroreflectivity of the improved retroreflector is anticipated to be brighter than those Model 944 reflectors manufactured by applicants' assignee and used in conjunction with the Model 96 and 96LP markers; and additionally, the reconfiguration of the reflector and the associated casting will permit plow blade operators to increase the plow blade angle a significant amount while minimizing the potential damage to the retroreflector that now occurs when such angles are increased beyond about 25°-30°.

The present invention also permits use of a single casting under more widely varied plowing conditions while forming it of such structure and dimension as to allow it to be more readily reclaimed.

In the '945 patent, snowplowable monodirectional and bidirectional pavement markers are disclosed which include a metal base member having two arcuate-bottom keel members interconnected by an arcuate-bottom support member. The upper surfaces of the keel members respectively define inclined ramps from a plane at one end of the base member toward the other end thereof to corresponding coplanar top surfaces. The support member has a support surface lying below the plane for supporting thereon a retroreflector which is partially recessed below the plane. The keel members and the support member are respectively secured in complementary arcuate recesses with the plane of the retroreflector support surface substantially parallel with the roadway surface.

In designing these prior art snowplowable pavement markers, it has been a continuing problem to reduce the overall height of the reflector associated with the pavement marker to a minimum level above the roadway surface without undesirable reduction of the retroreflectance of the marker and, accordingly, the visibility of the marker. For example, in attempts to achieve low profile marker designs heretofore, it has been recognized that the angle between the roadway surface and the inclined ramps of the base member should be minimized to reduce the impact of the plow blade on that portion of the housing or casting projecting above the roadway. However, although the ramp angle theoretically could be reduced as low as desired, the lower the angle, the longer the ramp would have to be to maintain the same maximum height and, accordingly, the longer the keel members and the longer the grooves or recesses that would have to be cut in the pavement. The longer the grooves, the greater the time and expense required to form the grooves. Furthermore, the longer the base member, the heavier and more expensive it is. Thus, these factors have served practically to limit to no lower than 6° the outside ramp angle (6.5° inside ramp angle) that could be practically achieved in a prior art bidirectional marker with the full retroreflective area of the existing retroreflectors operatively exposed.

In further attempting to minimize the overall height of the markers above the roadway, it has been suggested in the prior art to further recess the retroreflector elements below the level of the roadway surface. However, in so doing, it has been found that the retroreflectivity and, therefore, the visibility of the marker from a distance can be seriously impaired due to shadowing caused by the lower silhouette of the imbedded devices. Partially recessing the reflector elements reduces visibility only if the lowest unshadowed ray from an approaching headlight after refraction at the obverse face strikes the retroreflective element above the lowest point of the cube corner.

Another problem which has been recognized in the design of snowplowable markers is the need to provide devices having improved impact and compression resistance of the retroreflector. In this regard, the development of highly durable devices which would withstand high speed vehicular impact as well as the stress of heavy and frequent plowing has been a primary objective of these devices.

A further problem in the design of these products has been the need to provide devices which enable improved tire wiping action to be exerted over the surface of the retroreflector to clean such surface and improve the retroreflectivity thereof without adversely impacting the longevity of the products.

Therefore, there is provided in the present invention a pavement marker specifically structured and dimensioned for use in snow areas which includes an improved base member adapted to be embedded in the pavement and having inclined ramps and a retroreflector consisting of a housing and a retroreflective lens assembly, the retroreflector being carried by the base member in a manner such that the retroreflective lens is partially recessed in use below the level of the roadway surface to minimize the total height of the pavement marker and the angle that the ramps make with the roadway surface, but with only a slight increase in the overall length of the pavement marker.

More particularly, it is a significant feature of the present invention that the angle which the ramps of the pavement marker make with the roadway surface enables smoother snowplowability without reducing the functional height of the retroreflector or the retroreflectance thereof.

It is another feature of the present invention that the distance between the inside edges of the inclined ramps is reduced to lower the chance of plowblade contact with the reflector during snowplowing. Preferably, this distance is reduced from about 4.9 inches in the prior Model 96 and 96LP versions, to approximately 3.54 inches, allowing for increased plow blade angle.

It is another feature of the invention that the ramps are constructed with increased lateral width in order to increase the strength of the casting. Preferably, the lateral width of the ramps is approximately 0.59 inch. In addition, flanges are formed on each side of the casting, each flange having a width of approximately 0.235 inch and extending for about 5 inches along the casting parallel to the longitudinal axis. The flanges taper into the ramps at each end at a 10° angle to the casting wall. The flanges increase the sturdiness and strength of the casting so that it will withstand the forces applied to it during various tumbling and cleaning techniques and also serve to protect the positioning tabs during such recycling.

Another feature of this invention is the manner in which the reflector housing is accommodated within the base member for better protection from plow blades and the base member also is relieved in front of the lens assembly to promote improved wiping action of passing vehicle tires over the reflector lens.

It is still another important feature of the present invention that the retroreflector housing, in which the lens assembly is positioned, is reduced in length from approximately 2.00 inches to 1.68 inches. The shorter length of the retroreflector housing further lessens the opportunity for contact by a passing plow blade.

An important aspect of the present invention is that the improved retroreflector housing is constructed of a long fiber-reinforced thermoplastic material having properties which demonstrate superior performance in cold temperatures. The material used is such that improved impact and compression resistance of the retroreflector housing assembly in the pavement marker is achieved along with excellent abrasion resistance, especially extending across the top of the reflector.

With a shorter retroreflector, longer casting ramps, and narrower ramp spacing, the retroreflector is provided with much greater protection from snowplow damage. The present invention should provide greater longevity and require less frequent reflector replacement versus present designs when used under similar traffic conditions. These advantages should reduce the cost of traffic control, labor and the like and thus reduce the exposure of maintenance crews to traffic hazards.

Another important feature of this invention is that the face angle of the front face or lens portion of the lens assembly is inclined at an angle which results in reduced abrasive action of sand and road salts caused by tire action. This face angle is in the range of 30°–45° and preferably is approximately 35° relative to the roadway surface.

Furthermore, the lens assembly of the present markers will incorporate a double reflex cell (two retroreflective cube corner elements per cell) surrounded by a wall. Significantly, the double cube corner arrangement should provide improved retroreflectivity, and, accordingly, better visibility of the marker, while providing adequate wall strength to prevent breakage of the lens element. The multiple cell walls also should minimize propagation of damage to adjacent cells.

SUMMARY OF THE INVENTION

These advantages are obtained, and it is a general object of the present invention to obtain these advantages by providing a low-profile pavement marker base member for use in snow areas which utilizes a retroreflector carried by the base member to provide a marking visible from an oncoming vehicle. The base member is designed to be inset into the finished roadway surface and is structured and dimensioned to protect the retroreflector from damage by oncoming snowplow blades during snowplowing operations and to achieve improved cleansing of the reflector lens assembly by the action of automotive tires wiping over the surface of the lens assembly as the vehicle passes thereover.

The pavement marker includes a base member with two longitudinally extending and laterally spaced apart keel portions each approximately 10 inches in length and extending below a plane defined by the pavement. The keels are to be disposed and secured in first and second complementary recesses in the associated pavement.

The base member has two inclined upper ramp surfaces, the inside edges of which are laterally spaced apart a distance of about 3.54 inches (compared with the 4.9 inch spacing of the prior "96" and "96LP" markers) to reduce the probability of plowblade contact with the retroreflector carried by the base member. The inclined upper surfaces each forms a ramp inclined to the roadway surface, the principal or longest portion having an outside maximum angle of 5.25°, the inclined ramp having an inner edge and an outer edge extending longitudinally of the base member from a point adjacent to one end thereof upwardly toward the other end thereof and rising from the plane to an uppermost portion at differing angles.

The base member includes a support portion interconnecting the keel portions and extending below the plane and adapted to be disposed in a complementary recess formed in the associated pavement. The support portion has a support surface disposed between the inclined surfaces adjacent to the uppermost ends thereof and lying below the plane of the roadway in use.

The support surface is disposed between and below the inclined ramps and provides a recessed area into which the retroreflector is inserted for better retention and so that an oncoming snowplow blade will ride up the ramps and be deflected from contact with the retroreflector as the snowplow blade passes over the pavement marker. The support portion further includes a relieved section in front of the lens assembly of the retroreflector and intermediate the keel portions which recess enables improved tire wiping action over the front surface of the lens assembly.

The lens assembly and the retroreflector housing extend from below the plane defining the roadway surface to thereabove so as to be visible from oncoming vehicles and to be exposed to wiping action by the tires thereof when the base member is received and secured in the complementary recess, whereby the retroreflector is protected from contact with oncoming snowplow blades. The longer length of the casting increases the distance between the front face of the retroreflector lens element and the point of contact with the ramps by the plow blade.

BRIEF DESCRIPTION OF THE DRAWINGS

These and other objects of the present invention will be more clearly understood in connection with the accompanying detailed description of the attached drawings in which.

DETAILED DESCRIPTION OF THE DRAWINGS

Figure 1:
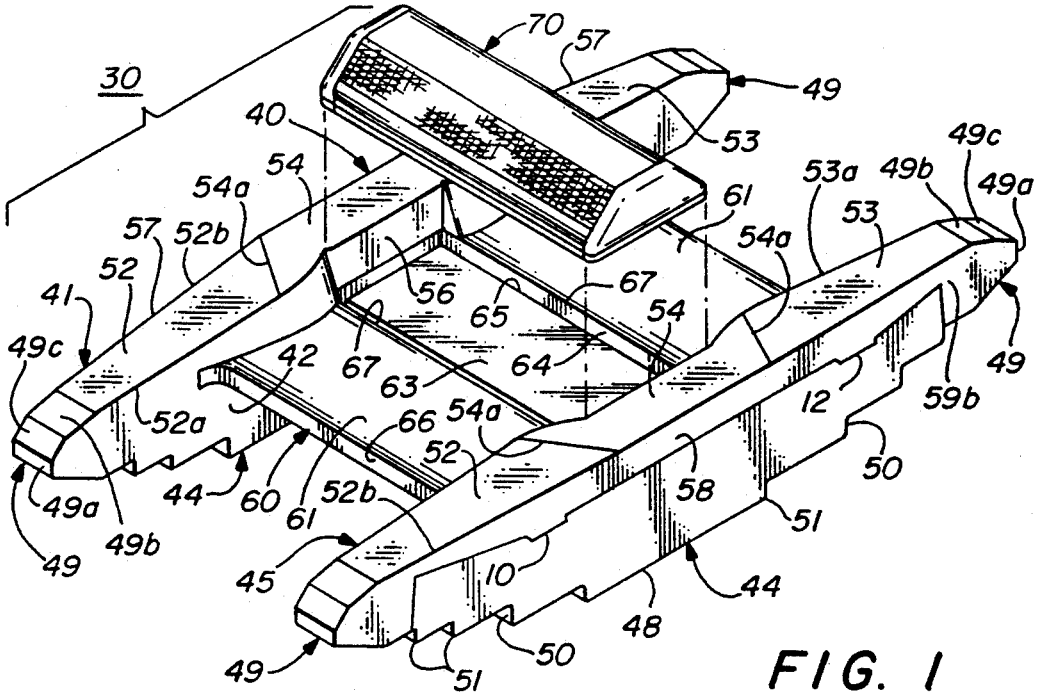
FIG. 1 is an exploded front perspective view of a pavement marker, including a base member and a retroreflector, constructed in accordance with and embodying the features of the present invention.

Referring now to FIGS. 1 though 7 of the drawings, there is illustrated a snowplowable pavement marker, generally designated by the numeral 30. In use, the pavement marker 30 is fixedly embedded in the pavement 20 of a roadway (see FIG. 5) so as to project above the pavement surface 21 and be visible from oncoming vehicles traveling in either direction along the roadway, while being protected from oncoming snowplow blades 25 inclined at an angle A (FIG. 2) with respect to the transverse axis of the base member (which also is perpendicular to the direction of travel D). The pavement marker 30 is bidirectionally plowable, and includes a base member, generally designated as 40, which is formed of a relatively high-strength material, such as pearlitic ductile iron, grade D5506, SAE J434 with a cast hardness of 179-255 Brinell. It supports thereon the new retroreflector, generally designated by the number 70.

The general overall structure of the casting is similar to that illustrated, described and claimed in the aforementioned U.S. Pat. No. 4,195,945, commonly assigned.

The improved base member 40 preferably is cast as an integral unit, and includes a pair of parallel, elongated, laterally spaced apart keel members 41 and 45, the keel member 41 having parallel substantially vertically extending inner and outer side surfaces 42 and 43, and the keel member 45 having parallel substantially vertically extending inner and outer side surfaces 46 and 47. The inside surfaces 42 and 46 are spaced apart about 3.54 inches (instead of 4.9 inches as in the prior versions). Thus, the snowplow blade can be placed at a greater angle with respect to a line perpendicular to the direction of travel (Angle A) without engaging the retroreflector.

Each of the keel members 41 and 45 is provided with a substantially identical irregular bottom surface, generally designated by the number 44, which interconnects the respective side surfaces 42 and 43 and the side surfaces 46 and 47 along the bottoms of the keel members. Each of the irregular bottom surfaces 44 includes a flat horizontal bottom portion 48 disposed centrally of the keel member and a pair of downwardly sloping and slightly arcuate end portions 49 lying substantially along a common arc of an imaginary circle C shown in FIG. 7 and respectively extending downwardly from the opposite ends of the keel member toward the bottom portion 48, each of the end portions 49 being interconnected with the adjacent end of the flat bottom portion 48 by a plurality of substantially right-angular step portions 50. The step portions 50 define a plurality of tooth-like points 51, all of which lie along an imaginary circle C and function to retard slipping or shifting of the base member 40 with respect to the pavement 20, when installed with appropriate adhesive (not shown).

Each of the keel members 41 and 45 also is provided with a principal pair of inclined ramp surfaces 52 and 53 which respectively rise from the opposite ends of the keel member to uppermost portions which join a substantially flat top surface 54 and interconnect the side surfaces 42, 43 and 46, 47 at radiused corners to prevent stress concentrations where the base member 40 may be struck by a plow blade. The lower ends of the ramps 52 and 53 respectively join short inclined surfaces **49*b* and 49*c* which slope downwardly from the inclined surfaces 52 and 53 toward the adjacent ends of the base member 40. The inclined surfaces 49*c* are respectively connected to the end portions 49 by short vertical end surfaces 49*a* and the inclined surfaces 49*b* are interposed between the inclined surfaces 52, 53, and the inclined surfaces 49*c***.

Figure 6:
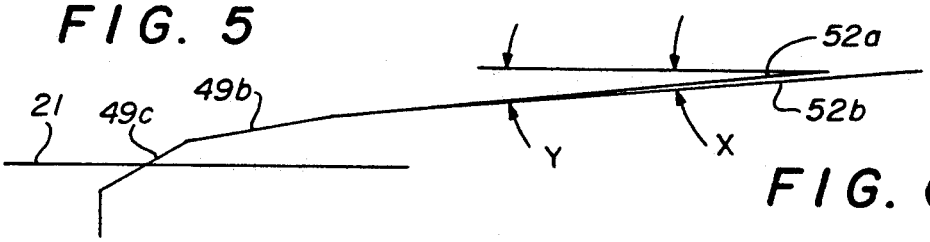
FIG. 6 is an enlarged fragmentary side elevational view of a portion of the base member shown in FIG. 5.

The base member 40 has a plane P (see FIG. 7) which, in use, is intended to be coplanar with the plane of the associated pavement surface and is substantially parallel to the top surfaces 54 and intersects the short inclined surfaces **49*c* intermediate the length of such surfaces between their lines of intersection with the surfaces 49*b* and the end surfaces 49*a*. The short inclined surfaces 49*b* and 49*c* of the keel member 41 are respectively coplanar with the short inclined surfaces 49*b* and 49*c* of the keel member 45. Preferably, the surfaces 49*c* are inclined at an angle of approximately 30° with respect to the plane P and the surfaces 49*b*** are inclined at an angle of approximately 10° with respect to plane P (see FIG. 6).

The purpose of the short inclined surfaces **49*b* and 49*c* is to allow the tips 49*a* of the ramps to be disposed below the pavement. The plowblade then will not strike the end 49*a*** and possibly cause the casting to be dislodged from the pavement.

Figure 3:
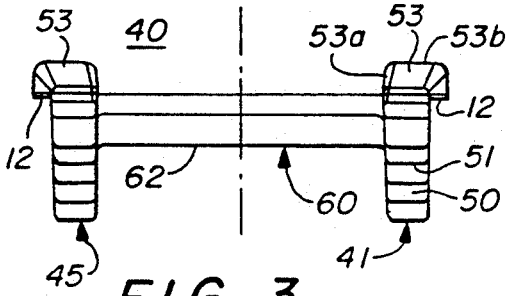
FIG. 3 is an end elevational view of the base member as viewed in the direction of the arrows 3—3 in FIG. 2.

Each of the inclined ramp surfaces 52 has an inner edge **52*a* which is inclined with respect to the plane P at a first acute angle X (see FIG. 6), and an outer edge 52*b* which is inclined with respect to the plane P at a second acute angle Y. In like manner, each of the inclined upper surfaces 53 has an inner edge 53*a* which is inclined with respect to the vertical at the angle X (see FIG. 3), and an outer edge 53*b* which is inclined with respect to the vertical at the angle Y. Thus, each of the inclined ramp surfaces 52 and 53 is slightly sloped downwardly longitudinally and laterally outwardly of the base member 40**.

More particularly, the inner edges **52*a* of the ramp 52 intersect the top surfaces 54 a slight distance forwardly of the points where the outer edges 52*b* intersect the top surfaces 54, the base member 40 being oriented with the longitudinal axis thereof extending parallel to the direction of travel D, so that the lines of intersection 54*a* between the inclined upper surfaces 52 and the top surfaces 54 are each disposed at an acute angle Z with respect to a line perpendicular to the direction of travel D. In like manner, the inner edges 53*a* of the inclined upper surfaces 53 intersect the top surfaces 54 a slight distance forwardly of the points where the outer edges 54*b* intersect the top surfaces 54, so inclined upper surfaces 53 and the top surfaces 54** are each disposed at an angle Z with respect to a line perpendicular to the direction of travel D.

While inclining the inner and outer ramp edges is taught in applicants' assignee's prior U.S. Pat. No. 4,147,447, the present invention, with wider ramps, narrower distance between ramps, and shorter retroreflector, more readily accommodates a larger plowblade angle, as hereafter noted.

The upper inner surfaces 42 and 46 of the ramps 52 and 53 of each keel 41 and 45 include recessed inner side wall portions 56 positioned centrally thereof. Flanges 57 and 58, respectively, extend longitudinally along and laterally outwardly from the upper portion of keel members 41 and 45, and from the ramp portions thereof. The flanges 57 and 58 each have bottom surfaces 59 that are coplanar and lie slightly above the plane P. Each flange has a width of approximately 0.235 inch and extends for approximately 5 inches and is centered longitudinally on the keel. Each flange then tapers into the ramp members 52 or 53 at an angle C (FIG. 2) of approximately 10°.

These flanges increase the sturdiness and strength of the casting during high speed plowing and also during tumbling of the casting during recycling. The flanges also serve to engage the adhesive placed in the complementary cuts in the roadway surface. Installation projections or tabs 10 and 12 with downwardly facing surfaces defining the plane P are provided along the bottom edge of each of the flanges 57 and 58 to provide level installation of the casting on irregular pavement surfaces. The flanges 57, 58 also serve to protect the tabs 10, 12 during removal of the casting and during tumbling or other processing of the casting if it is recycled.

Figure 2:
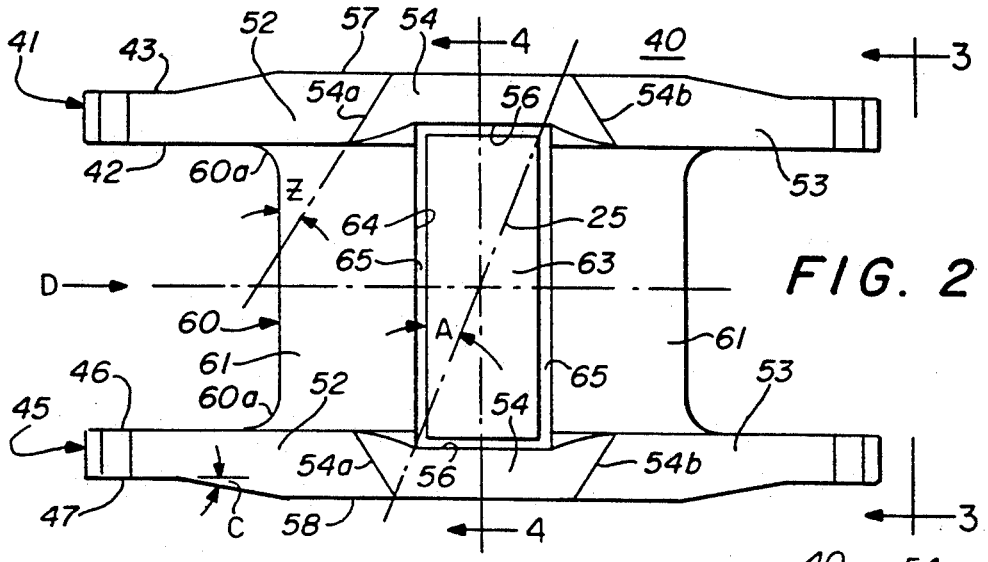
FIG. 2 is a top plan view of the base member of the pavement marker of FIG. 1.

The portions of the inner surfaces 42 and 46 of the keel members 41 and 45 extending from approximately midway between the ends of the ramp 52 and 53 are interconnected by a web-like support member, generally designated by the numeral 60. The support member 60 is substantially rectangular in plan outline and has radiused shoulders or flanges **60*a*** formed at each of the four corners thereof for strength as best shown in FIG. 2.

Figure 5:
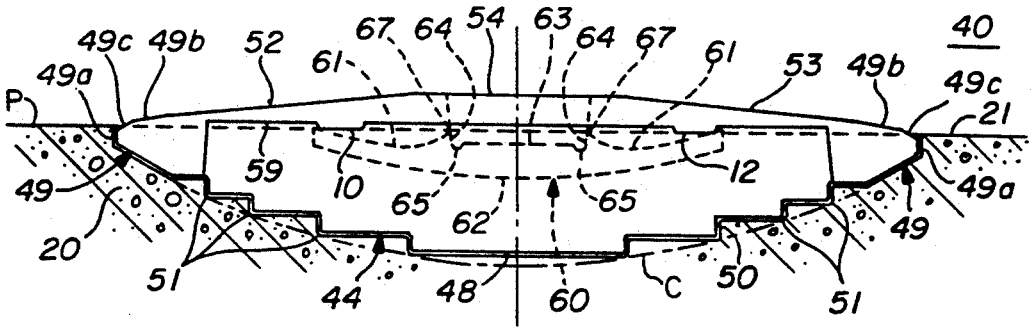
FIG. 5 is a side elevational view of the base member of FIG. 1 shown installed in the pavement.
Figure 7:
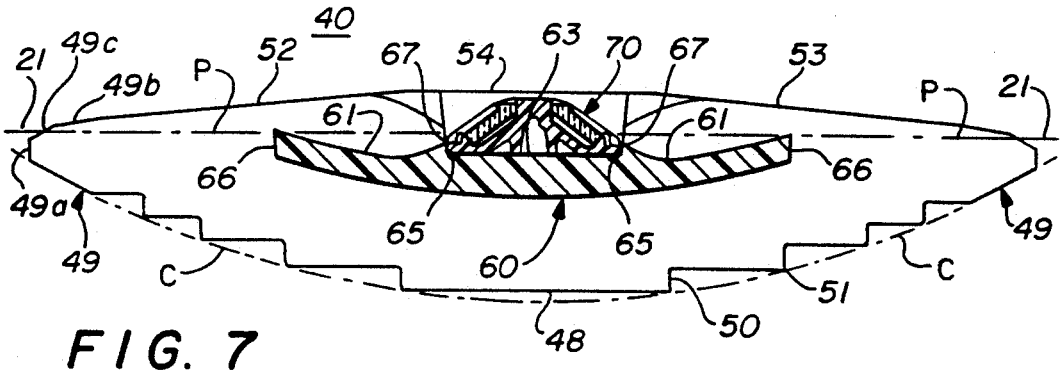
FIG. 7 is a view in vertical section of the pavement marker base with a retroreflector positioned on the base member.

As best illustrated in FIGS. 1, 5 and 7, the support member 60 has a pair of concave recesses 61 in the top surface and an arcuate part-cylindrical convex bottom surface 62. The top and bottom surfaces 61 and 62, respectively, are connected at the opposite outer ends by short vertical end surfaces 66. The inner ends of the concave top surfaces 61 are radiused upwardly to form retention lips or abutments 67 (FIG. 7) having substantially vertical inner end walls 64 extending downwardly from the apices of the lips 67 at opposite longitudinally spaced ends of a central planar support surface 63. While such concave top surfaces are suggested in the '945 patent, no prior device employing same was made.

The support surface 63 lies below the plane P and extends transversely across the support member 60 and between keels 41 and 45.

Figure 4:
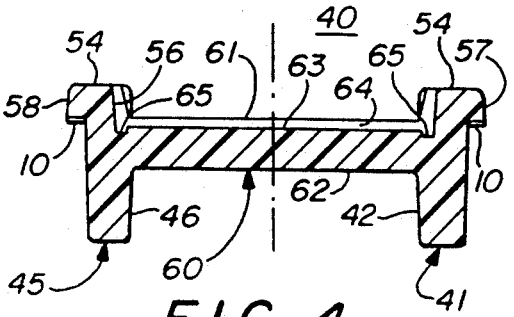
FIG. 4 is a cross-sectional view in vertical section taken along the line 4—4 in FIG. 2.

Longitudinally, the support surface 63 extends substantially coextensive with the recessed side wall portions 56 of the keel members 41 and 45. The end walls 64 and the recessed inner side wall portions 56 of the keel members 41 and 45 are all connected to the support surface 63 by a peripheral channel or groove 65 which extends around the support surface 63 and is generally arcuate in transverse cross section (FIG. 4).

This arrangement also allows the entrance of a vehicle tire onto the arcuate surfaces 61 in front of a retroreflector 70 positioned on the support surface 63. As a result thereof, the wiping action of the tires on the lens is improved.

An important feature of the present invention is the relationship between the retroreflector 70 and the keel portions 41 and 45. The reflector 70 herein has a length (taken in the direction of travel "D" as shown in FIG. 2) of 1.68 inches, as compared to a length of 2.00 inches for the prior Model '944 reflectors. Further, the keel portions 41 and 45 are 10 inches in length instead of 9.25 inches and, at their inside ends, are spaced 3.54 inches apart rather than 4.9 inches as in the prior models of castings. The combination of the narrower reflector entrance, defined by the 3.54 inch spacing, the slightly longer keels, and the narrower reflector dimensions of 1.68 inches, provide much greater protection to the retroreflector from snowplow blade damage, and allow larger plow blade angles to be utilized.

For example, in the prior model 96 and 96LP castings, if the plow blade were such that the outer end or tip of the blade did not straddle the furthest ramp, then the largest plow blade angle A, before the tip would graze the reflector, was about 20°; whereas in the present invention that angle is about 35°. Similarly, where the plow blade "straddled" both ramps, the prior devices could accept a plow blade angle of 38°, while the improved device can accept about 50°, before the straddling blade contacts the retroreflector.

Figure 8:
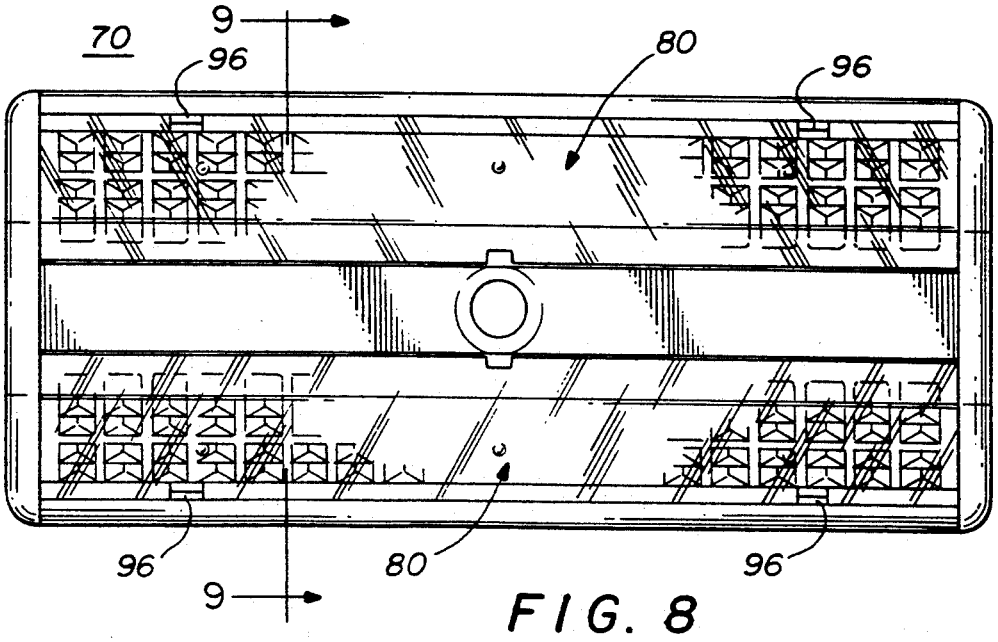
FIG. 8 is an enlarged top plan view of the retroreflector assembly of FIG. 1, and schematically illustrating some cube-corner retroreflector elements therein.
Figure 9:
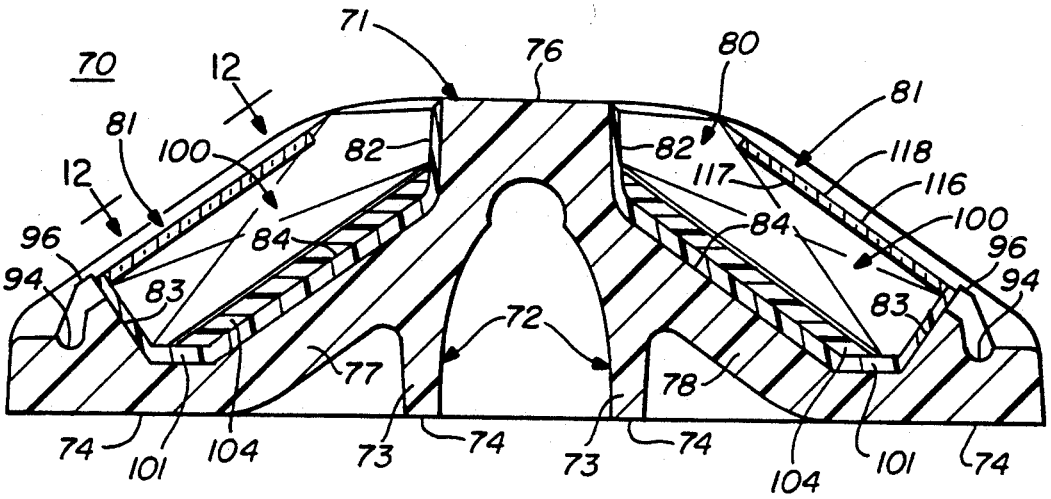
FIG. 9 is a view in vertical section taken along the line 9—9 in FIG. 8 of the retroreflector illustrating the lens assembly positioned in the housing.
Figure 10:
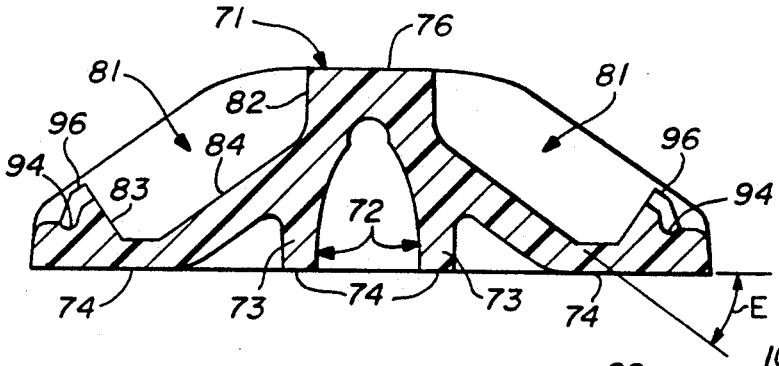
FIG. 10 is a view similar to FIG. 9, without the lens assembly therein.

Referring now to FIGS. 8–10 of the drawings, the retroreflector 70 is structured and dimensioned to fit between the end walls 64 and the recessed inner side wall portions 56 to be supported upon support surface 63 of the casting or base member 40. In a preferred form, the retroreflector 70 includes a housing or body 71 and a retroreflective lens assembly, generally designated by the numeral 80.

An important aspect of the invention is the structure and material of the retroreflector, and particularly that of the housing 71. The housing or body 71 preferably is molded of a long-fiber-reinforced thermoplastic material having high impact strength, stiffness and dimensional stability. The material also exhibits excellent corrosion and wear resistance as well as excellent properties in cold temperatures.

Certain prior art patents have disclosed the use of two dissimilar materials for the retroreflector lens and a base or housing. One, for example, is Balint U.S. Pat. No. 3,409,344 (which discloses two acryclic lens elements in a housing formed of arcrylonitrilebutadienestyrene (ABS). That marker is intended to be "potted" or filled with a rigid epoxy, much as disclosed in applicants' assignees prior U.S. Pat. No. 3,332,327. However, the disadvantages in using a "metallized" lens and "filled" or "potted" housing is that there is well known degradation of retroreflective efficiency. See also, for example, U.S. Pat. No. 4,070,095. However, the "potted" reflector provides a strong, durable marker. In the present invention, improved reflectivity is obtained while, surprisingly, obtaining improved durability without the use of a "potted" marker.

It is a requirement herein that the reflector housing be of a material of better impact strength than the prior Model 944 all acrylic "potted" marker, enabling the housing to absorb some of the forces and energy of impacting tires and perhaps plow blades, but not too soft a material which would flatten out from such continuous loading. The material needs a combination of the following characteristics: rigidity for compressive strength; toughness and resilence to absorb impact forces and energy; a degree of stiffness for flexural strength; and ductility to avoid separation upon failure. These are particularly true where the cellular type reflector construction disclosed and claimed herein is utilized. These must, of course, be accompanied also by weatherability, chemical resistance, abrasion and mar resistance in a material which also is capable of economical injection molding. In the present case, the long glass fiber thermoplastic materials, using a carbon black pigment for ultraviolet absorption, provides,"in combination with the double cube corner cell lens element, a marker more durable than the "filled" type Model 944 reflectors utilized with applicants' assignee's model 96 and 96LP base members.

Exemplary of long-fiber compositions suitable for use in forming the housing 71 are long-glass-fiber composites employing matrix resins such as Nylon 6, 6/6, 6/10, and 6/12 grades; and other resinous compounds such as PS, SAN, PC, PP, PE, ABS, PES, PSF, PPO, PU, PPS, PET, PBT, SMA and acetal copolymers. Suitable long-glass-fiber composites for use herein are commercially available under the trade names "Fiberstran" from Akzo Corporation; "Celstran" from Polymer Composites, Inc.; "Vertron" from ICI Advanced Materials Inc.; and "Valox HS 4050" from GE Plastics.

The housing or body 71 of the reflector assembly 70, being molded from these long-fiber-reinforced thermoplastic materials, demonstrate both impact and compression resistance exceeding that of the filled retroreflectors of the prior raised pavement markers. In this regard, the combined attributes possessed by the retroreflector of the present invention of high impact strength or resistance which is associated with flexibility upon impact, and high compression strength which is normally associated with inflexibility, are uniquely improved functional characteristics.

The housing 71 is constructed with an open rib type structure 72 (FIG. 9), configured to provide optimum strength characteristics to the assembly 70 while conserving material and enabling good flow during injection molding. The rib structure 72 includes vertical segments 73 with essentially horizontal bottom walls 74 for cooperatively engaging the support surface 63 of base member 40 on which the assembly 70 is installed. The rib structure 72 also includes a top wall 76 that is raised above the vertical segments 73 and is interconnected to those segments 73 via opposed inclined front and rear web members 77 and 78 and substantially vertical central web members or ribs 73. Webs 77, 78, and 73 are formed integrally with the housing 71 and their bottom walls 74 extend transversely and their periphery is essentially coextensive with the support surface 63 of base member 40.

Each of the inclined web members 77 and 78 is shaped to accommodate a retroreflective lens assembly generally designated by the numeral 80, within recess 81 formed in the obverse face of the webs 77 and 78. Each recess 81 has an inclined top wall 82 and a bottom wall 83 extending perpendicular to an inclined rear wall 84 which is integral with walls 82 and 83. Top wall 82 is substantially perpendicular to surface 76, and wall 83 is inclined about 35° outwardly.

In a preferred embodiment of this invention, rear wall 84 is inclined at an angle E (FIG. 10) of approximately 35° so that when the lens assembly 80 is installed within the recess 81, the top, bottom and rear sides thereof, designated 85, 86, and 87 (FIG. 11), respectively, will be in abutment with the walls 82, 83, and 84 and the obverse front face 88 of the lens 80 will likewise present a face angle of approximately 35° relative to the roadway surface.

Lenses installed within the housing 71 at such a face angle are subject to less abrasion resulting from sand and road salts being pressed by tires against the face 88 of the lens 80 than if the face is at a lower angle. Moreover, this angle still will allow adequate wiping of the reflector front face, basically as taught in Heenan U.S.

Pat. No. 3,332,327. Also, as a result of the configuration of the recesses 81 in the webs 77 and 78, each installed lens assembly 80 is protected along its top and bottom edges by the housing 71, whereby the long-fiber-reinforced thermoplastic material from which the housing is molded will provide protection for the lens by absorbing the impact of oncoming vehicle tires.

The lens assembly 80 may be installed in recess 81 employing a toughened adhesive 101 such as Versilok 406 with accelerator 17 sold by Lord Corporation of Erie, PA.

The cube-corner type lens element 102 to be employed herein may be selected from a variety of known systems, such as those disclosed in U.S. Pat. No. 4,195,945, issued to S. A. Heenan on Apr. 1, 1980, and U.S. Pat. No. 4,340,319, issued to S. A. Heenan et al on Jul. 20, 1982, both commonly assigned. The lens assembly 80 consists of a lens 100 and a lens backing 104. The particular arrangement of the three cube faces will be selected based upon the desired reflective pattern for the unit, the angle of the front face of the lens 100 to the road surface, and whether enhancement for orientation, observation or entrance angle response is desired. Predetermined selection of that cube face arrangement for proper optic and molding conditions is within the skill known in the cube-corner reflector art.

In the preferred form, each grouping of two cube corner retroreflector elements 102 is completely surrounded by a wall and a backing member to provide a hermetically sealed cell. Alternatively, for strength and added support, the lens elements 102 may comprise a single cube corner element surrounded by a wall, such as shown in Flanagan U.S. Pat. No. 4,498,733, also commonly assigned.

The retroreflector 70 preferably is installed on support surface 63 of the casting 40 with an adhesive 68. One such adhesive is commercially available under the product name from Eclectic Products Inc. of Carson, CA.

It will be understood that the retroreflector assembly 70 may be assembled to the base member 40 either before or after the base member 40 is installed on the pavement. Significantly, the adhesive attachment of the retroreflector assembly 70 to the base member 40 permits later removal and replacement of the assembly 70 in the event it becomes damaged, worn or the like, without necessitating removal of the base member 40 from the pavement.

It is important in reducing the overall height of the marker of the present invention that when the retroreflector assembly 70 is mounted upon the support surface 63 of base member 40, part of the cube corner elements 102 in the reverse face of the lens 100 lie below the plane P as shown in FIGS. 7 and 9, but nevertheless, because of refraction of the light striking the obverse surface at plane P, the recessed portions of the cube corner elements retroreflect incident light impinging on all portions of the lens front face, as taught in the '945 patent.

Furthermore, the vertical distance between the top of top wall 76 of the housing 71 and the bottom walls 74 of vertical segments 73 is such that when the reflective lens assembly 70 is mounted in place upon the support surface 63 of the base member 40, the reflective lens assembly 70 is at all points thereof below the top surface 54 of the base member 40 a predetermined distance sufficient to prevent contact of the reflective assembly 70 by the corners or tips of angled plow blades set at an angle no greater than 35° to the line perpendicular to the direction of vehicle travel (to accommodate a blade that does not "staddle" both ramps).

As can be seen in FIG. 10, at the upper outermost edge of lower or bottom recess wall 83 there is provided a continuous groove 94 to accept and retain any adhesive residue (used to hold the glass to the retroreflector lens) to prevent the residue from blocking the retroreflective action of the lens. At least a pair of tangs 96 (FIG. 10) are disposed adjacent each edge of the lower recess wall 83 and are adapted to position and assist in retaining the lens assembly 80 and its glass coating in the appropriate location in recess 81.

The upper or top wall 82 of the recess 81 may have a longitudinally extending brow or lip (not shown) or overhang that provides some of the housing material to protect the lens assembly 80 from impact and tire abrasion forces. In the illustrated embodiment in FIG. 11 the lens 100 includes a brow 103 integrally formed therewith, which helps to protect the upper edge of the glass 116 from tire abrasion forces which can crack the glass.

Figure 11:
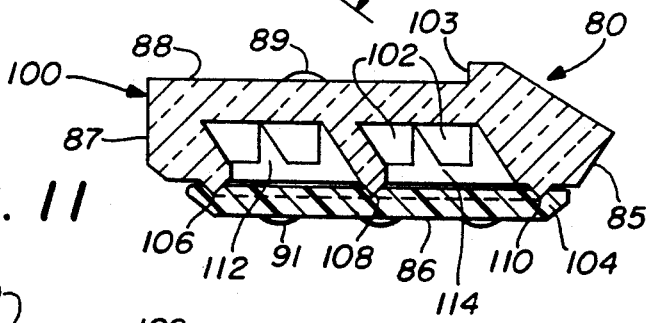
FIG. 11 is an end view of the retroreflective lens assembly as used in the housing of FIG. 10, with portions of the cube-corner elements representatively shown.
Figure 12:
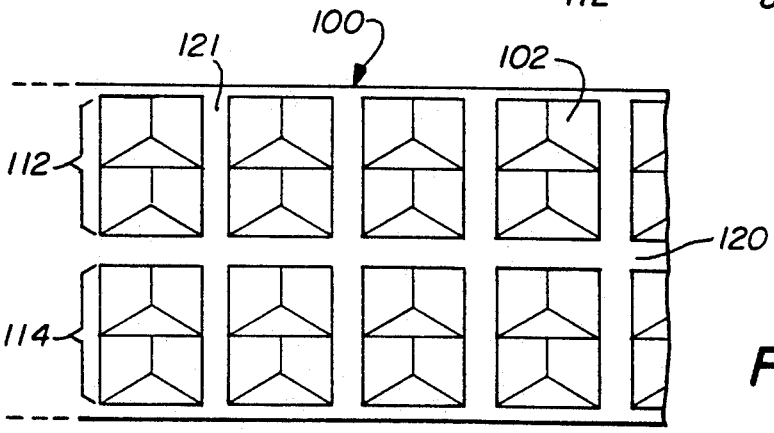
FIG. 12 partial view of the front face of the lens element of FIG. 11, taken in the direction of the arrows 12—12 in FIG. 9, and illustratively representing several retroreflector elements within cell walls.

Because in the improved marker the reflector lens is formed of a different thermoplastic material (such as acrylic) than the housing 71 and would not readily sonic weld to the housing, the lens backing 104 is secured to the underside of the retroreflective lens element 100 by ultrasonic welding at energy directors along the bottoms of all cell walls as can be seen at points 106, 108 and 110 of FIG. 11. The energy directors actually melt into the part.

A glass plate 116 is applied to the lens 100 and is adhesively secured thereto at 118 just below the brow 103. A protrusion 89 is provided on lens face 88 to properly space the glass and control the thickness of the adhesive layer.

The glass may be applied generally in accordance with U.S. Pat. No. 4,340,319, commonly assigned, the disclosure of which is incorporated by reference herein. The glass 116 is applied after the lens assembly 80 is secured to the housing 71 to provide a solid substrate to maintain the glass in compression throughout the anticipated operating range of the unit. The preheat temperature during installation is generally about 150° F.

As can be seen in FIG. 11, the lens assembly 80 comprises the lens element 100 and the lens backing 104. The lens 100 shown is injection molded from an acrylic or other optically satisfactory material and is shown with two reflecting cube corner elements per cell, although, depending upon the amount of reflectance versus strength required, it may have a single retroreflective cube corner element per cell or other combination of numbers of retroreflective elements. The two rows 112 and 114 of double-cube corner reflective cells are particularly effective for a snow country unit. The two rows of cells are separated by a thicker wall 120, while adjacent cell columns are separated by thinner portions 121 of the integral peripheral wall.

In a preferred embodiment, the overall width of the housing 71 is about 3.89 inch; the width of the lens 100 is about 3.61 inch; the projected height of the lens is about 0.40 inch; the width of horizontal wall 120 between rows of cells is about 0.038 and that of vertical wall 121 between columns of cells is about 0.020.

In installation of the pavement marker 30 on the pavement 20, the base member 40 must be embedded in the pavement so that the basal plane P of the base member 40 will lie substantially in the plane of the roadway surface 21. This necessitates that the bottom portions of the keel members 41 and 45 and the support member 60 respectively be recessed below the roadway surface 21 in corresponding generally complementary grooves or recesses in the pavement 20.

The pavement marker 30, and particularly the base member 40 thereof, has been constructed to facilitate the installation of the pavement marker 30 on the pavement 20 so that the support surface 63 lies below the roadway surface 21, or plane P, thereby to minimize the height of the pavement marker 30 above the roadway surface 21 so as to maintain an angle of less than 6° between the inclined upper surfaces 52 and 53 and the roadway surface 21 while enlarging the overall length of the pavement marker 30 to 10 inches, disclosed in the '945 patent.

More particularly, as was described above, the bottom surfaces 44 of the keel members 41 and 45 are generally arcuate in overall outline (although in "stepped" configuration), and the bottom surface 62 of the support member 60 also is arcuate in outline (FIG. 7), thereby permitting the keel members 41 and 45 and the support member 60 to be respectively received in the complementary arcuate grooves or recesses in the pavement 20. Such arcuate grooves can be conveniently cut with circular cutting blades suitable for cutting concrete or the like. Equipment for installing such markers is generally shown in U.S. Pat. No. 4,174,184, commonly assigned, and, indeed, routinely used to form the arcuate keel recesses for installing snowplowable pavement markers of the Model 96 and 96 LP markers. Adjustment of the blade arrangement may be necessitated by the dimensional changes of the improved base member 40. Appropriate adhesive is placed in the grooves prior to installation of the casting, in a well known manner.

In a constructional model of the pavement marker 30, the base member 40 is preferably an integral metal casting, the dimensions of which are such that when installed in place on the pavement in the position illustrated in FIG. 5, the maximum height of the pavement marker 30 above the roadway surface 21 is approximately 0.41 inch and the overall length of the base member 40 is approximately 10.00 inches. The edges of the ramps preferably are inclined at an outer edge angle of 5.25°, and at an inside edge angle of 5.5° relative to the plane P. This decrease in angles relative to the predecessor Model 96 casting is achieved by increasing the length of the casting, increasing the lead angle surface **49*c* at the bottom of the ramp to 30° from 15° and adding a second lead angle surface 49*b* at 10° for 0.35 inch. The principal inclined portion of each ramp 52 or 53** therefore starts about 0.050 inch above the plane P, or the pavement.

Thus, in view of the low angle of inclination of the ramps combined with the low height of the marker, the impact of snowplow blades against the base member 40 as compared to the Model 96 is materially reduced, which results in a reduction of the "jolt" felt by the driver of a plow and minimizes the impact on the underlying roadway surface as well as reduces the area of unplowed road surface caused by the raising of the plow blade. Furthermore, the impact forces transmitted to the tires of vehicles which pass over the marker are reduced. Also, the changes in ramp angles reduces "scarfing" of the ramps by tungsten carbide plow blades. Experience has shown that with adhesive around the ends of the keel ends and movement of the plow, the blade seldom strikes the lead edges **49*c* or 49*b*** of the ramps, thus allowing those angles to be significantly steeper than the 5.5° inside ramp angle. It should be noted these angles compare as follows:

| MODEL | RAMP ANGLES Outside | Inside |
|---|---|---|
| New | 5.25 | 5.5 |
| 96 | 6.0 | 6.5 |
| 96LP | 4.0 | 4.5 |

The vertical distance between the top surface 54 and the support surface 63 is 0.61 inch, the total height of the top surface 54 above the plane P is 0.41 inch and the total height of the lens assembly 80 is 0.49 inches. Therefore, the support surface 63 is 0.20 inches below the plane P or pavement surface and because the adhesive thickness is about 0.020 inches, the top 76 of the housing is approximately 0.10 inches below the ramp top surface 54.

An important aspect of this invention is that although the new retroreflector uses less cube corner area than the Model 944 (about 55% of the reflector area), because the new unit is unmetallized and "unfilled" it will still provide enhanced retroreflectivity compared to the prior Model 944 reflector used in the Model 96 and 96LP castings.

For example, using nominal reflector design values, the following specific intensities are intended to be achieved, at 0° entrance angles, for a crystal or clear lens:

| RETROREFLECTANCE NOMINAL DESIGN VALUES SPECIFIC INTENSITY | | | |
|---|---|---|---|
| Observation Angle | Model 96 | Model 96LP | New Reflector & New Casting |
| .2° | 4.0 | 2.4 | 5.2 |

It is noted however that the performance of the new reflector at larger entrance angles (such as 20°), will decrease.

There has been provided a pavement marker of the character described wherein the housing for the retroreflector lens assembly is formed of a long-fiber-reinforced thermoplastic material. This novel concept provides significant structural advantages than other previously used plastics, particularly at the lower operating temperatures at which the snowplowable markers will be exposed.

In the preferred embodiment, the lens is formed of impact modified polymethylmethacrylate such as Rohm & Haas MI-7, and the housing is formed of long fiber reinforced thermoplastic Celstran N50G from Polymer Composites, Inc., Winona, Minn., using glass fiber lengths of about 0.5 inch.

While the casting disclosed is particularly useful in combination with the novel retroreflector disclosed, it will be understood that other retroreflectors may be utilized with such casting and still achieve many of the advantages of the invention, such as increased plow blade angle acceptance. Likewise, the improved retroreflector could in certain instances be used independently of the casting, in "sun-country" conditions where no road plowing occurs. In such event, the size of the reflector may change, as well as the numbers of cells and cube-corner elements.

While there have been described what are at present considered to be the preferred embodiments of the invention, it will be understood that various modifications may be made therein, and it is intended to cover in the appended claims all such modifications as fall within the true spirit and scope of the invention.

We claim:

1. A low-profile pavement marker for use in snow areas for establishing on a finished roadway surface a retroreflected signal visible to an oncoming vehicle while protecting the retroreflector from damage by oncoming snowplow blades during snowplowing operations comprising:

a base member and a retroreflector;

said base member having first and second laterally spaced-apart and longitudinally extending ramp members, said ramp members integrally formed with said base member, each ramp member having an upper portion comprising a principal inclined surface;

said base member having a lower portion, said lower portion defining a longitudinally extending keel portion structured and dimensioned to be recessed below the associated roadway surface with the upper portion of each said ramp member extending above the roadway surface;

means defining a plane on said base member, said plane coplanar with the associated roadway surface;

the inner side walls of said ramp members being separated by a distance of about 3.5 inches from one another and further having a support member interconnecting said ramp members and providing a downwardly facing bottom surface structured and dimensioned to be disposed in a recess formed in the associated pavement;

said support member having a central generally planar support surface for carrying said retroreflector thereon;

said planar support surface being disposed below said plane defining means;

said retroreflector comprising a housing formed of a long-fiber-reinforced thermoplastic material and a retroreflective lens of a different material secured thereto, said housing and said lens being structured and dimensioned to be disposed on said support member between and substantially below the principal inclined surface of each of said ramp members, with a portion of the lens disposed above the roadway surface, so that an oncoming snowplow blade will ride up said ramp members and be deflected thereby from contact with said lens as the snowplow blade passes over said pavement marker;

said ramps being so configured and arranged to provide adequate space therebetween to allow vehicle tires to wipe the front fact of said retroreflective lens; and said bottom surface of said support member being below said place defining means and recessed in use below the level of the associated roadway surface enabling minimization of the total height of said base member above the roadway surface thereby to reduce the impact energy imparted to said base member and the pavement by oncoming vehicles striking said base member.

2. The pavement marker of claim 1, wherein said long-fiber-reinforced thermoplastic material is a long-glass-fiber composite to provide high impact strength, stiffness and dimensional stability.

3. The pavement marker of claim 1, wherein the housing has a length of about 1.68 inches.

4. The pavement marker of claim 1, wherein said housing comprises:

a ribbed structure including vertical segments for cooperatively engaging a support surface;

a top wall raised vertically above said vertical segments;

web members interconnecting said vertical segments and said top wall; and at least one of said web members having an obverse face and including an inclined recess formed in the obverse face thereof to accommodate said retroreflective lens.

5. The pavement marker of claim 4, wherein said recess has a top wall and a bottom wall interconnected by an inclined rear wall, said rear wall being inclined at an angle of approximately 35° relative to said top wall.

6. The pavement marker of claim 5, wherein said retroreflective lens is accommodated in said recess in a manner such that an exposed face of said lens presents a face angle of approximately 35° relative to said plane.

7. The pavement marker of claim 1, wherein said retroreflector is adhesively attached to said support surface.

8. The pavement marker of claim 1, wherein said means defining said plane comprises at least one downwardly facing surface integral with said base member and structured and dimensioned to engage the associated roadway surface to properly position the base member relative to the roadway surface.

9. The pavement marker of claim 1, wherein said support surface is structured and dimensioned relative to the plane defining means such that said surface will be recessed below the associated roadway surface and will carry the retroreflective lens with at least a lower operative portion thereof disposed below said plane.

10. The pavement marker of claim 1, wherein said first ramp member includes a first central top surface parallel to said roadway surface and said second ramp member includes a second central top surface coplanar with said first top surface.

11. The pavement marker of claim 10, wherein said first and second top surfaces are disposed substantially midway between opposite longitudinal ends of said ramp members and said support member is centered between and below said first and second top surfaces, whereby said pavement marker is snowplowable from either longitudinal direction, and the overall length of said base member is about 10 inches.

12. The pavement marker of claim 1, wherein said principal inclined surface on each of said ramps has an inner edge and an outer edge, said inner edge being inclined at an angle of approximately 5.5° relative to said plane and said outer edge being inclined at an angle of approximately 5.25° relative to said plane.

13. The pavement marker of claim 1, wherein each of said inclined surfaces extending between said outer and said top surface of said inclined ramps includes three inclined regions, the first said region being inclined at an angle of approximately 30° relative to said plane, the second said region being inclined at an angle of approximately 10° relative to said plane and said third principal region being inclined at an angle of less than approximately 6° relative to said plane.

14. The pavement marker of claim 1, wherein said base member includes a pair of downwardly facing flanges, each respectively extending longitudinally along and laterally outwardly from a respective ramp member; and at least two spaced projections on the bottom surfaces of each said flange which are coplanar and which serve as said means to define said plane.

15. The pavement marker of claim 14, wherein said flanges extend longitudinally on each side of the center line of the casting parallel to its longitudinal axis.

16. The pavement marker of claim 15, wherein each end of each of said flanges tapers into the respective ramp members at an angle of approximately 10°.

17. The pavement marker of claim 16, wherein each said flange:

has a width of approximately 0.235 inch and has a length of approximately 5 inches.

18. A low-profile pavement marker for use in snow areas for establishing on a finished roadway surface a retroreflected signal visible to an oncoming vehicle while protecting the retroreflector from damage by oncoming snowplow blades during snowplowing operations comprising:

a base member and a retroreflector;

said base member having integrally formed first and second laterally spaced-apart ramp members extending longitudinally from one end of said base member to the other, each said ramp member having a lower portion and an upper portion and an inclined surface extending between each outer end and a top surface to form an inclined ramp;

the lower portion of said ramp member defining a longitudinally extending keel portion structured and dimensioned to be recessed below the associated roadway surface with the upper portion of each said ramp member extending above the roadway surface;

means defining a plane on said base member, said plane intended to be coplanar with the associated roadway surface when the marker is installed;

said ramp members having a support member interconnecting said ramp members and providing a downwardly facing bottom surface structured and dimensioned to be disposed in a recess formed in the associated pavement;

said support member having a central generally planar support surface for carrying said retroreflector thereon;

said planar support surface being disposed below said plane defining means;

said retroreflector comprising a housing formed of a first thermoplastic material and a retroreflective lens assembly of a different thermoplastic material secured thereto, said housing and lens assembly being structured and dimensioned to be disposed on said support member between and substantially below the top surface of said ramp members, with a portion of the lens assembly disposed above the roadway surface, so that an oncoming snowplow blade will ride up said ramp members and be deflected thereby from contact with said lens assembly as the snowplow blade passes over said pavement marker;

said ramps being so configured and arranged to provide adequate space therebetween to allow vehicle tires to wipe the retroreflective lens;

said support member having upwardly facing concave cylindrical top surfaces longitudinally interconnected by said central support surface and being structured and dimensioned to provide relief in said base member between said ramps in front of said reflective lens assembly to further promote tire wiping action over said lens; and said bottom surface of said support member being below said plane defining means and recessed in use below the level of the associated roadway surface enabling minimization of the total height of said base member above the roadway surface thereby to reduce the impact energy imparted to said base member and the pavement by oncoming vehicles striking said base member.

19. The pavement marker of claim 18, wherein said retroreflector and said base member ramps are cooperatively structured and dimensioned such that the pavement marker can accommodate the movement thereof of part or all of a snow plow blade inclined at an angle not in excess of 50° measured from the perpendicular to the longitudinal axis of the base member, without such plow blade engaging any part of the retroreflector, when such blade straddles said ramps, and not in excess of 35° when the blade contacts only one of said ramps.

20. A base member for use as a component of a low profile pavement marker for use in snow areas for establishing on a finished roadway surface a retroreflective marker visible from an oncoming vehicle while protecting the marker from damage by oncoming snowplow blades during snowplowing operations, said base member comprising:

integrally formed first and second laterally spaced-apart and longitudinally extending ramp members, each said ramp member having a lower portion and an upper portion and an inclined surface extending between each outer end and a top surface to form an inclined ramp;

the lower portion of said base member defining a longitudinally extending keel portion structured and dimensioned to be recessed below the roadway surface with the upper portion of each said ramp member extending above the roadway surface;

said ramp members being separated by a distance of substantially about 3.5 inches from inside to inside whereby said base member can accommodate the movement thereover of a snowplow blade straddling the ramps and disposed at an angle not in excess of 50° measured perpendicular to the longitudinal axis of the base member before any part of the plow blade may impact an associated reflector mounted on the base member;

a support member interconnecting said ramp members and providing a downwardly facing bottom surface to be disposed in a complementary recess in the associated pavement;

means on said marker defining a plane such that when said marker is installed said plane will be substantially coplanar with the associated roadway surface;

said support member having a central generally planar support surface for carrying an associated retroreflective marker thereon;

said ramps being so configured and arranged to provide adequate space therebetween to allow vehicle tires to wipe the reflective markers and said support surface of said base member being recessed in use below the level of the associated roadway surface enabling minimization of the total height of said base member above the roadway surface thereby to reduce the impact energy imparted to said base member and the pavement by oncoming vehicles striking said base member.

21. The base member of claim 20, wherein said means defining said plane includes at least one downwardly facing surface integral with said base member and structured and dimensioned to engage the associated roadway surface to properly position the base member relative to the roadway surface.

22. The base member of claim 20, wherein said support surface is structured and dimensioned relative to the plane defining means such that said surface will be recessed below the associated roadway surface and will carry an associated retroreflector with at least a lower portion thereof disposed below said plane.

23. The base member of claim 20, wherein said first ramp member includes a first central top surface parallel to said roadway surface and said second ramp member includes a second central top surface coplanar with said first top surface.

24. The base member of claim 20, wherein said first and second top surfaces are disposed substantially midway between opposite longitudinal ends of said ramp members and said support member is centered between and below said first and second top surfaces.

25. The base member of claim 20, wherein the inclined surface on each of said ramps has an inner edge and an outer edge, said outer edge being inclined at an angle of approximately 5.25° relative to the roadway surface.

26. The base member of claim 20, wherein each of said inclined surfaces extending between said outer end and said top surface of said inclined ramps includes three inclined regions, the first said region being inclined at an angle of approximately 30° relative to said plane, the second said region being inclined at an angle of approximately 10° relative to said plane and said third principal region being inclined at an angle of less than approximately 6° relative to said plane.

27. The base member of claim 20, wherein said base member includes a pair of downwardly facing flanges each respectively extending longitudinally along and laterally outwardly from a respective ramp member; and at least two spaced projections on the bottom surfaces of each said flange which are coplanar and which serve to define said plane.

28. The base member of claim 27, wherein said flanges extend longitudinally on each side of the center line of the casting parallel to its longitudinal axis.

29. The base member of claim 27, wherein each end of each of said flanges tapers into the respective ramp member at an angle of approximately 10°.

30. The base member of claim 27, wherein each flange has a width of approximately 0.235 inch and has a length of approximately 5 inches.

31. The base member set forth in claim 20, wherein the length of said base member is about 10 inches.

32. The base member set forth in claim 20, wherein said base member is about 10 inches long, the outside edge angle of said ramp relative to said plane is about 5.25°, the height of said ramps above said plane is no greater than about 0.41 inch, and the inside dimension between said ramps is no greater than substantially about 3.5 inches.

33. A low-profile pavement marker for use in snow areas for establishing on a finished roadway surface a marking visible from an oncoming vehicle while protecting the marking from damage by oncoming snowplow blades during snowplowing operations, said pavement marker comprising a base member as set forth in claim 20, and, in combination therewith, a retroreflector disposed between and below said ramp members and carried by said support surface, said support surface being disposed below said plane, said retroreflector having a lower portion adapted to be disposed below said plane, and an upper portion adapted to be disposed above said plane and both the upper portion of the retroreflector and at least a part of the lower portion thereof are operative to reflect light incident upon the upper portion of the retroreflector from an oncoming vehicle back toward said vehicle and said ramps are so configured and arranged to provide adequate space therebetween to allow vehicle tires to wipe at least the upper portion of the retroreflector, said retroreflector comprising a cube corner reflex reflector having an inclined front surface disposed at an angle to the roadway surface of between 30° and 45°.

34. The pavement marker set forth in claim 33, wherein said retroreflector includes a housing formed of a long-fiber thermoplastic material and wherein said reflector comprises a retroreflective lens element formed of a different thermoplastic material.

35. A retroreflective pavement marker for retroreflecting light from an oncoming vehicle to the vehicle driver comprising:

a molded housing formed of a long-fiber-reinforced thermoplastic material having high-impact strength, stiffness and dimensional stability; and a retroreflective lens element formed of a different thermoplastic material and affixed to said housing.

36. The pavement marker set forth in claim 35, wherein said lens element includes a front face which is provided with an abrasion resistant surface, thereby to further protect said lens element from abrasive action of materials forced or blown thereupon.

37. The pavement marker set forth in claim 36, in which said abrasion resistant surface comprises a microthin sheet of untempered glass affixed to the front face of said lens element so that said glass is in compression throughout the anticipated temperature range of use of said lens element.

38. The pavement marker set forth in claim 35, wherein said housing comprises:

a ribbed structure including vertical segments for cooperatively engaging a support surface;

a top wall raised vertically above said vertical segments;

web members interconnecting said vertical segments and said top wall; and at least one of said web members having an obverse face and including an inclined recess formed in the obverse face thereof to accommodate said retroreflective lens element.

39. The pavement marker of claim 38 wherein said recess has a top wall and a bottom wall interconnected by an inclined rear wall, said rear wall being inclined at an angle of approximately 35° relative to the roadway surface.

40. The pavement marker of claim 38 wherein said retroreflective lens is accommodated in a recess formed in a manner such that an obverse front face of said lens system presents a face angle of approximately 35° relative to the roadway surface.

41. The pavement marker of claim 38 wherein the molded housing has a length in the travel direction of 1.68 inches.

42. The pavement marker of claim 35 wherein the long-fiber-reinforced thermoplastic is a long-glass-fiber composite.

43. The pavement marker set forth in claim 38, wherein said lens element comprises two rows of cells, each cell containing at least one retroreflective cube corner element therein.

44. The pavement marker set forth in claim 38, wherein, there are two retroreflective cube corner elements in each said cell.

* * * * *